US011661682B2

(12) United States Patent
Wixmerten et al.

(10) Patent No.: US 11,661,682 B2
(45) Date of Patent: May 30, 2023

(54) FABRIC AND BELT CONTAINING IT FOR SHEAR STRESSING APPLICATIONS

(71) Applicant: Habasit AG, Reinach (CH)

(72) Inventors: Bodo Wixmerten, Allschwil (CH); Bernd Roser, Steinen (DE); Roland Troesch, Weil am Rhein (DE); Brent Whitehead, Bacup (GB); Michael Tyler, Harrogate (GB)

(73) Assignee: Habasit AG, Reinach (CH)

( * ) Notice: Subject to any disclaimer, the term of this patent is extended or adjusted under 35 U.S.C. 154(b) by 449 days.

(21) Appl. No.: 16/485,958

(22) PCT Filed: Feb. 14, 2018

(86) PCT No.: PCT/EP2018/053613
§ 371 (c)(1),
(2) Date: Aug. 14, 2019

(87) PCT Pub. No.: WO2018/149845
PCT Pub. Date: Aug. 23, 2018

(65) Prior Publication Data

US 2020/0056308 A1 Feb. 20, 2020

(30) Foreign Application Priority Data

Feb. 15, 2017 (EP) ..... 17156315

(51) Int. Cl.
*D03D 1/00* (2006.01)
*D03D 11/00* (2006.01)
*D03D 13/00* (2006.01)

(52) U.S. Cl.
CPC ..... *D03D 1/0094* (2013.01); *D03D 11/00* (2013.01); *D03D 13/004* (2013.01); *D10B 2331/021* (2013.01); *D10B 2331/04* (2013.01)

(58) Field of Classification Search
None
See application file for complete search history.

(56) References Cited

U.S. PATENT DOCUMENTS 4,877,126 A 10/1989 van Calker et al.
2008/0147198 A1* 6/2008 Cherok ..... A61F 2/0063 623/23.72
2010/0323574 A1 12/2010 Dunleavy

FOREIGN PATENT DOCUMENTS

DE 2234915 A1 3/2007
EP 0309605 A1 10/1987
(Continued)

OTHER PUBLICATIONS

Machine translation of JP 2002068440 (Year: 2002).*

*Primary Examiner* — Shawn Mckinnon
(74) *Attorney, Agent, or Firm* — Hodgson Russ LLP

(57) ABSTRACT

A woven fabric comprising: a) A first layer of first uncrimped weft filaments; b) a second layer of second uncrimped weft filaments; wherein for each of the first uncrimped weft filaments there is one corresponding second uncrimped weft filament, and vice versa, to form successive filament pairs of first and second uncrimped weft filaments, c) crimped warp filaments having four different weave types c1-c4, but each weave type consisting of entwining around first uncrimped weft filaments; passing between first and second uncrimped weft filaments; entwining around second uncrimped weft filaments; and passing again between first and second uncrimped weft filaments; and d) uncrimped warp filaments passing between the first uncrimped weft filaments and the second uncrimped weft filaments of all filament pairs; wherein the fabric does not comprise crimped warp filaments which entwine around the first uncrimped weft filaments and the second uncrimped weft filaments in alternating manner. This fabric has good resistance to shear
(Continued)

delamination and wear-and-tear delamination of an impregnation (11) impregnated into the fabric. Accordingly the fabric can be used in belts intended for applications wherein shear stress between the belt's top surface (9) and the belt's bottom surface (10) in the belt's longitudinal direction may occur.

16 Claims, 4 Drawing Sheets

(56) References Cited

FOREIGN PATENT DOCUMENTS

| | | | |
|---|---|---|---|
| GB | 1273528 | A | 5/1972 |
| GB | 1390603 | A | 4/1975 |
| GB | 2101643 | A | 1/1983 |
| JP | 2002-068440 | A1 | 3/2002 |
| WO | 2015/011090 | A1 | 1/2015 |

* cited by examiner

FABRIC AND BELT CONTAINING IT FOR SHEAR STRESSING APPLICATIONS

TECHNICAL FIELD

The present application relates to fabric containing conveyor belts and to uses of such conveyor belts in applications where shear stress is applied to the belt.

PRIOR ART

Conveyor belts generally consist of a base fabric and top layers adhering to the base fabrics. The top layers may be of rubber, elastomer, thermoplastic and thermoset materials which are either/or chemically or physically attached to the base fabric which is usually of polyester or aramid. Conveyor belts have to be highly flexible to successfully work within a conveyor application. For ease of end-joining by welding together of the open ends it is preferred that the top layers consist of a thermoplastic or thermoplastic elastomer which upon such end-joining may act as the hot-melt adhesive and weldable/joinable to make into an endless belt. The belt design must be able to resist liquids, solvents, oils and wide variety of other chemicals, with abrasion resistance to solid materials, whist subjected to external/internal longitudinal, lateral and surface tensions/contractions, such as shear, under various operating and environmental conditions, with multiple, repetitive impacts whist simultaneously maintaining a good degree of dimensional stability. Such operational forces can damage interplay adhesion (embedded or laminated weaker adhesive forces between the fabric and polymer).

DE2234915 discloses a conveyor belt with two individual fabrics, each of the fabrics having a first and second layer of uncrimped weft filaments and second crimped warp filaments passing over uncrimped weft filaments of the first layer, then passing between uncrimped weft filaments of the first and second layer, then passing below uncrimped weft filaments of the second layer and then passing between uncrimped weft filaments of the first and second layer. None of the two fabrics has uncrimped warp filaments passing between the uncrimped weft filaments of the first and second layer. This publication aims to reduce elongation of the belt and to improve its lateral stiffness or transverse rigidity ("Quersteifigkeit").

U.S. Pat. No. 4,877,126A discloses a conveyor belt wherein the fabric has a first and second layer of uncrimped weft filaments; both first crimped warp filaments passing in alternating manner over uncrimped weft filaments of the first layer and below uncrimped weft filaments of the second layer and second crimped warp filaments of the type as described above for DE2234915. This fabric however has no uncrimped warp filaments passing between the uncrimped weft filaments of the first and second layer.

GB2101643 discloses a belting fabric having a first, second and third layer of uncrimped weft filaments; crimped warp filaments passing, not necessarily in alternating manner, over uncrimped weft filaments of the first layer and under uncrimped weft filaments of the second layer, or passing, not necessarily in alternating manner, over uncrimped weft filaments of the second layer and under uncrimped weft filaments of the third layer; and uncrimped warp filaments passing between the first and second layer, or between the second and third layer, of uncrimped weft filaments. This fabric does however not contain any second crimped warp filaments of the type described above for DE2234915. This belting fabric is first impregnated and then covered, either on one or both sides of the fabric and if desired along the edges, with elastomeric material.

GB1273528 discloses a fabric having a first, second and third layer of uncrimped weft filaments; crimped warp filaments passing in alternating manner over uncrimped weft filaments of the first layer and under uncrimped weft filaments of the second layer, or passing in alternating manner over uncrimped weft filaments of the second layer and under uncrimped weft filaments of the third layer; and uncrimped warp filaments passing between the first and second layer, or between the second and third layer, of uncrimped weft filaments. This fabric does however not contain any second crimped warp filaments of the type described above for DE2234915. This fabric is preferably impregnated with vulcanisable or thermoplastic elastomer, e.g. rubber or PVC.

All four above mentioned publications are silent as to the behaviour of their belts under shear stress in longitudinal direction of the belt.

The present invention aims to provide an improved conveyor belt in view of its use under shear-stressing applications.

SUMMARY

The present invention provides a woven fabric comprising:

a) A first layer (A) of first uncrimped weft filaments running essentially in parallel to each other and being spaced apart from each other by a distance D;

b) a second layer (B) of second uncrimped weft filaments running essentially in parallel to each other and being spaced apart from each other by said distance D;

wherein for each of the first uncrimped weft filaments there is one corresponding second uncrimped weft filament, and vice versa, to form successive filament pairs, each such successive filament pair being designable with a unique and ascending integer index N;

c) crimped warp filaments having one of the following weave types c1-c4:

c1—entwine around first uncrimped weft filaments of all filament pairs with indexes N fulfilling (N mod 4)=0, such indexes N being designated as $N_A$; pass between first and second uncrimped weft filaments of all filament pairs with indexes N fulfilling (N mod 4)=1, such indexes N being designated as $N_B$; entwine around second uncrimped weft filaments of all filament pairs with indexes N fulfilling (N mod 4)=2, such indexes N being designated as $N_C$; and pass between first and second uncrimped weft filaments of all filament pairs with indexes N fulfilling (N mod 4)=3, such indexes N being designated as $N_D$; or c2—entwine around second uncrimped weft filaments of all filament pairs with said indexes $N_A$; pass between first and second uncrimped weft filaments of all filament pairs with said indexes $N_B$; entwine around first uncrimped weft filaments of all filament pairs with said indexes $N_C$; and pass between first and second uncrimped weft filaments of all filament pairs with said indexes $N_D$; or c3—pass between first and second uncrimped weft filaments of all filament pairs with said index $N_A$; entwine around first uncrimped weft filaments of all filament pairs with said indexes $N_B$; pass between first and second uncrimped weft filaments of all filament pairs with said indexes $N_C$; and entwine around second uncrimped weft filaments of all filament pairs with said indexes $N_D$; or c4—pass between first and second uncrimped weft filaments of all filament pairs with said indexes $N_A$; entwine around second uncrimped weft filaments of all filament pairs with said indexes $N_B$; pass between first and second uncrimped weft filaments of all filament pairs with said indexes $N_C$; and entwine around first uncrimped weft filaments of all filament pairs with said indexes $N_D$;

and d) uncrimped warp filaments passing between first and second uncrimped weft filaments of all filament pairs;

wherein the fabric does not comprise crimped warp filaments which entwine around first and second uncrimped weft filaments in alternating manner.

Preferred embodiments of the fabric are according to the description and dependent claims.

The invention furthermore provides belts containing such fabrics and applications of such belts wherein shear stress between the belt's top surface and the belt's bottom surface may occur.

DETAILED DESCRIPTION OF THE INVENTION

This development intends to use a thermoplastic polymer matrix flooded directly into unidirectional reinforced multilayer woven polyester fabric component woven joined layers, providing a fully impregnated, physical entanglement of thermoplastic polymer (preferred TPU) to form an embedded and entangled polymer/fabric matrix. Such entanglement to minimise layer separation, improves the polymer matrix bonding/adhesion characteristics and resistance to product ingress/commination issues and generally improves belt performance and service life, through good wear characteristics whilst providing good integral and dimensional flexibly.

Figure 1:
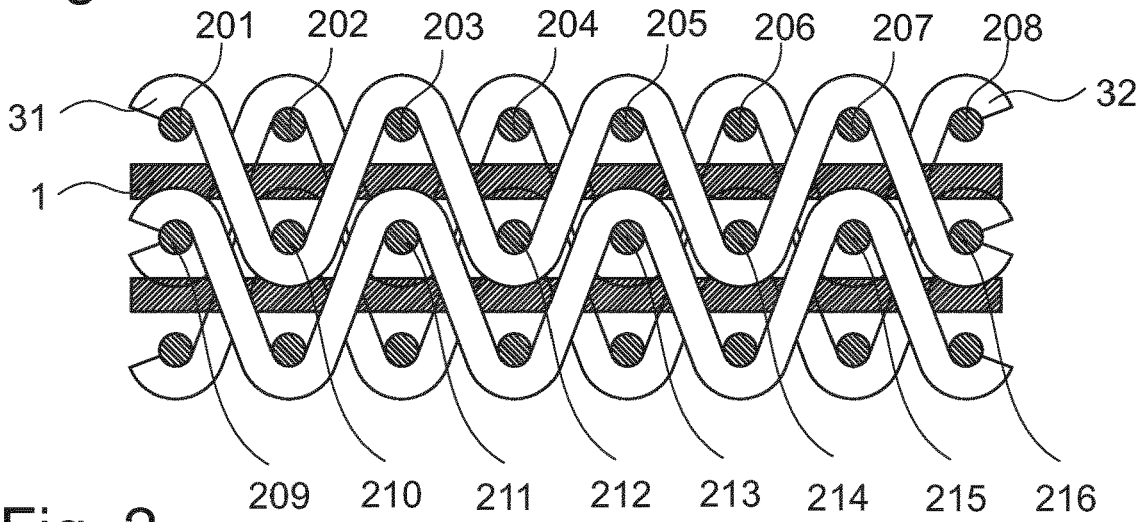
FIGS. 1-3 are schematic representations of the fabric of GB1273528, namely FIG. 1 as a cross-sectional view, FIG. 2 as a top view, and FIG. 3 again as cross-sectional view, but with only one crimped warp filaments, either under unsheared condition (top of FIG. 3) or under 20° shear (bottom of FIG. 3).

The fabric according to the invention has advantages in shear-intensive applications over the fabric of FIG. 1 of GB1273528, believed to be one closest prior art. This will be explained in detail with reference to FIGS. 1-6.

Figure 2:
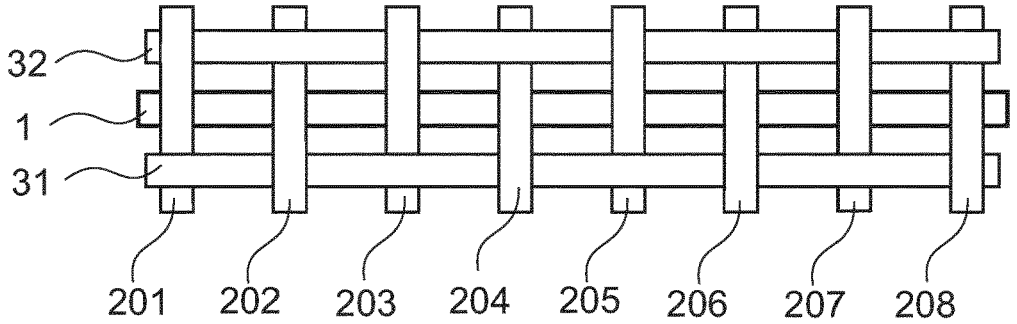
Figure 3:
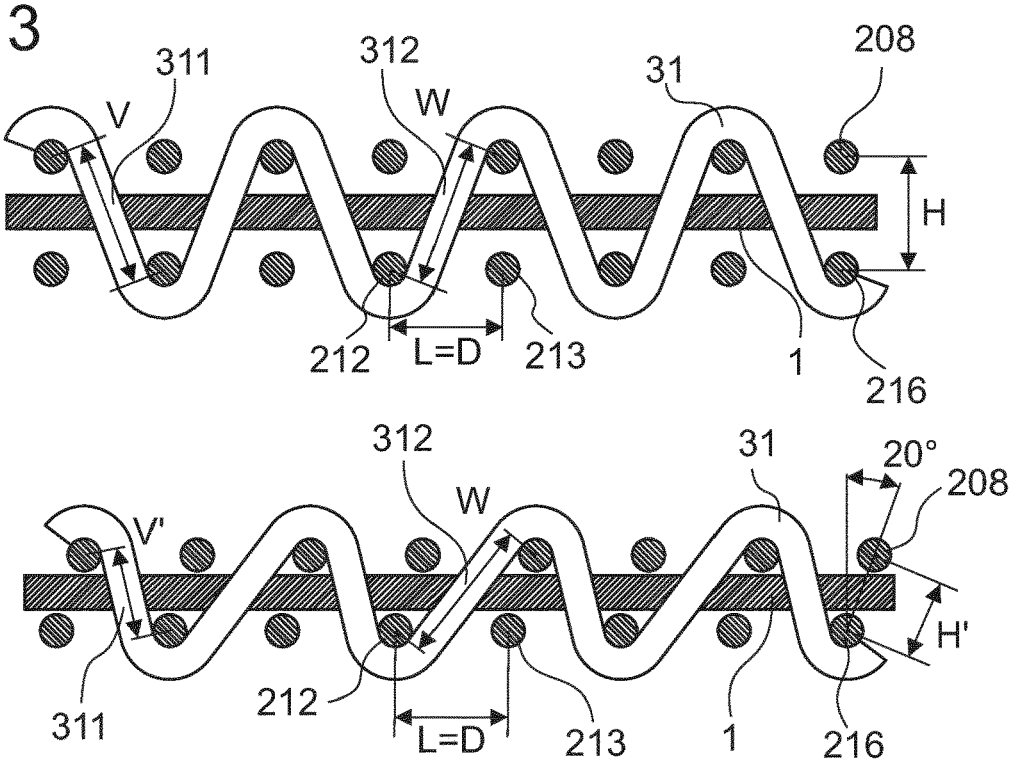

FIG. 1 (cross-sectional view) and FIG. 2 (top view) show said prior art fabric of FIG. 1 of GB1273528. This weave has central uncrimped warp filaments (one designated with numeral 1), uncrimped weft filaments (shown in cross-section in FIG. 1, some designated with numerals 201-216) and crimped warp filaments (the upper ones designated with numerals 31 and 32). The centres of adjacent uncrimped weft filaments (e.g. 212, 213) are spaced apart in warp direction of the fabric by a distance D which here is equal to the half-pitch distance L of the weave in warp direction, as shown in FIG. 3. Adjacent uncrimped weft filaments in vertical direction are matched in corresponding pairs (e.g. 208/216) the centres of which uncrimped weft filaments within a pair are separated in unsheared state by a vertical distance H. The crimped warp filaments 31, 32 entwine around the first uncrimped weft filaments 501, 502, 503, 504, 505, 506, 507, 508 and the second uncrimped weft filaments 509, 510, 511, 512, 513, 514, 515, 516 in alternating manner.

FIG. 3 is a schematic side view of the crimped warp filament 31 of FIGS. 1 and 2, once (upper part of FIG. 3) without shear and once (lower part of FIG. 3) at 20° shear. This filament 31 has, when seen in the fabric's warp direction from left to right, falling filament portions (one indicated with numeral 311) and rising filament portions (one indicated with numeral 312). When the fabric is sheared by 20° to the right (bottom part of FIG. 3) the rising filament portions 312 of the crimped warp filament 31 are under tensile stress. If the crimped warp filament 31 is assumed to be of reasonable tenacity then its rising filament portions 312 do not elongate noticeably under that tensile stress. The uncrimped warp filament 1 is of high tenacity (GB1273528 designates these central uncrimped warp filaments as "strength giving") and does not elongate noticeably under any tensile stress either. This means that the half-pitch L of the overall fabric and the length W of the rising filament portions 312 remain essentially constant in both unsheared and sheared state of the fabric, as shown in FIG. 3. The falling filament portions 311 of the crimped warp filament 31, however, are under compressible stress when the fabric is sheared by 20°. The presumed reaction of these falling filament portions 311 to such compressible stress is (for monofilaments) some bulging outwards from their longitudinal axis or (for multifilaments) some fluffing up of the individual filaments contained therein or some bulking up of the multifilament. This presumed reaction of the falling filament portions 311 to the compressible stress is believed to be a major reason for possible delamination of an impregnation adhering to these falling filament portions 311, and thus for delamination of such impregnation adhering to the warp filament 31. This presumed reaction of the falling filament portions 311 to compressible stress cannot be adequately shown in FIG. 3. Instead FIG. 3 shows a schematic shortening of the length of the falling filament portions 311 from V, unsheared state, to V', sheared state.

This schematic shortened length V' of the falling filament portions 311 is exactly calculable based on the shear angle, the filament diameters and the interfilament distances, and under said assumptions of L and W remaining constant as follows:

$$V' = \sqrt{W^2 + 4L\sin(\delta)\left(L\sin(\delta) - \sqrt{L^2\sin^2(\delta) + H^2}\right)} \quad (1)$$

wherein W is said length of the rising filament portions 312 (being equal in unsheared state and sheared state, being furthermore equal in unsheared state to the length V of the falling filament portions 311), this W being calculable as follows:

$$W = \sqrt{L^2 + H^2 - (X+Y)^2} \quad (2);$$

wherein L and H are as defined above; X is the diameter of the uncrimped weft filament(s) 201-216; Y is the diameter of the crimped warp filament 31; and δ is the shear angle.

For meaningful shear angles δ the sin(δ) is greater than or equal zero. Furthermore, since L and H are always greater than zero, then always $$L\sin(\delta)<\sqrt{L^2\sin^2(\delta)+H^2}$$

This means that the term in brackets in (1) is always smaller than zero. V' calculated by (1), at meaningful shear angle δ greater than zero, is then always smaller than W appearing in (1). Since W is equal to V, the length of the falling filament portions 311 in unsheared state, it follows that for any meaningful shear angle δ greater than zero the ratio V':V is smaller than 1. In the exemplary embodiment of FIGS. 1-3, wherein L=H=15 units, X=4.35 units, Y=4.35 units and 6=20°, one obtains with the above formulae: W=V=19.35 units, V'=12.42 units and V':V (=V':W)=0.642. This corresponds to a schematic shortening of the falling filament portions 311 at 20° shear of 35.8%. This is indicative of a significant bulging outwards from their longitudinal axis (if the crimped warp filament 31 is a monofilament) or of a significant fluffing up or bulking up (if the crimped warp filament 31 is a multifilament), and thus to a significant tendency of an impregnation adhering to these falling filament portions 311 to delaminate under shear.

The above considerations were made specifically for the crimped warp filament 31 appearing in FIGS. 1-2, but can be applied to any of the other crimped warp filaments shown therein, since they all have the same alternating entwinement with the uncrimped weft filaments.

However at given H and δ, the term $$4L\sin(\delta)(L\sin(\delta)-\sqrt{L^2\sin^2(\delta)+H^2})$$

appearing in (1) becomes closer to zero with increasing half-pitch L. This means that for increasing half-pitch L, the V' calculated with (1) at given H, X, Y, and 6 becomes closer to W appearing in (1). Accordingly, the ratio of V':V (=V':W) becomes closer to unity with increasing half-pitch L.

Figure 4:
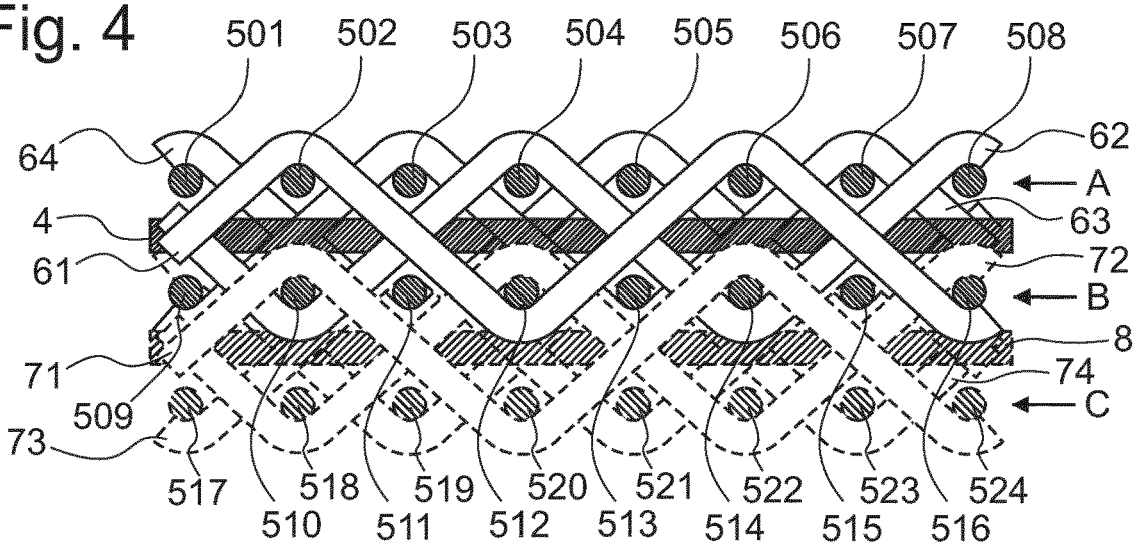
FIGS. 4-6 are schematic representations of the fabric of the invention, namely FIG. 4 as a cross-sectional view, FIG. 5 as a top view, and FIG. 6 again as cross-sectional view, but with only one crimped warp filaments, either under unsheared condition (top of FIG. 3) or under attempted 20° shear (bottom of FIG. 6).
Figure 5:
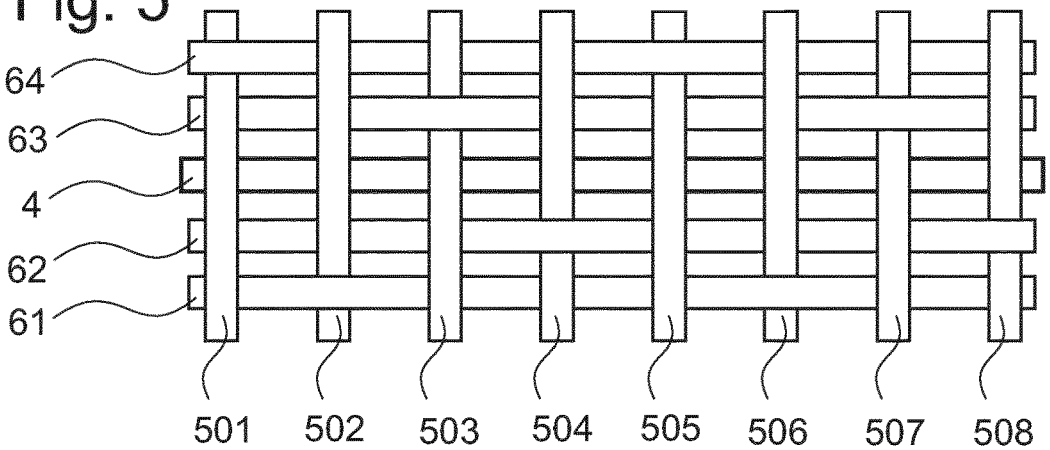

FIG. 4 (cross-sectional view) and FIG. 5 (top view) show an exemplary fabric of the instant invention. This fabric also has uncrimped warp filaments 4, first uncrimped and second weft filaments (shown in cross-section in FIG. 4), designated with numerals 501-508 and 509-516, respectively, and crimped warp filaments 61-64. To each of the first uncrimped weft filaments 501 resp. 502 resp. 503 resp. 504 resp. 505 resp. 506 resp. 507 resp. 508 there is one corresponding second uncrimped weft filament 509 resp. 510 resp. 511 resp. 512 resp. 513 resp. 514 resp. 515 resp. 516, and vice versa, to form successive filament pairs 501/509, 502/510, 503/511, 504/512, 505/513, 506/514, 507/515, 508/516. Each of these successive pairs is designable with an integer index; e.g. according to the following Table 1:

TABLE 1

| filament pair | Exemplary index N for filament pair |
|---|---|
| 501/509 | 239 (= $N_D$, because (N mod 4) = 3) |
| 502/510 | 240 (= $N_A$, because (N mod 4) = 0) |
| 503/511 | 241 (= $N_B$, because (N mod 4) = 1) |
| 504/512 | 242 (= $N_C$, because (N mod 4) = 2) |
| 505/513 | 243 (= $N_D$, because (N mod 4) = 3) |
| 506/514 | 244 (= $N_A$, because (N mod 4) = 0) |
| 507/515 | 245 (= $N_B$, because (N mod 4) = 1) |
| 508/516 | 246 (= $N_C$, because (N mod 4) = 2) |

The index N assigned to each of the successive filament pairs is arbitrary, provided that it increases with the order of the successive filament pairs in warp direction. The index N may be in a range of $N_{min}$ to $N_{max}$, wherein $N_{min}$ is the lowest possible index typically assigned to the first filament pair of the specimen of fabric in question, and wherein $N_{max}$ is the highest possible index typically assigned to the last filament pair of the specimen of fabric in question. Whether a given index N is assigned the designation $N_A$, $N_B$, $N_C$ or $N_D$ depends on the result of the modulo 4 operation performed on N, as evidenced by above Table 1. The modulo 4 operation (N mod 4), as used here, is the remainder obtained by the so-called "Euclidean integer division" of N by 4.

The weave types of the crimped warp filaments 61-64 in dependence of the above indexes $N_A$-$N_D$ of the filament pairs are as in following Table 2:

TABLE 2

| filament | $N_A$ | $N_B$ | $N_C$ | $N_D$ |
|---|---|---|---|---|
| 61 (weave type c1) | entwine around first uncrimped weft filament of such filament pairs | pass between first and second uncrimped weft filaments of such filament pairs | entwine around second uncrimped weft filament of such filament pairs | pass between first and second uncrimped weft filaments of such filament pairs |
| 64 (weave type c4) | pass between first and second uncrimped weft filaments of such filament pairs | entwine around second uncrimped weft filament of such filament pairs | pass between first and second uncrimped weft filaments of such filament pairs | entwine around first uncrimped weft filament of such filament pairs |
| 62 (weave type c2) | entwine around second uncrimped weft filament of such filament pairs | pass between first and second uncrimped weft filaments of such filament pairs | entwine around first uncrimped weft filament of such filament pairs | pass between first and second uncrimped weft filaments of such filament pairs |
| 63 (weave type c3) | pass between | entwine | pass between | entwine |

TABLE 2-continued

| filament | $N_A$ | $N_B$ | $N_C$ | $N_D$ |
|---|---|---|---|---|
| | first and second uncrimped weft filaments of such filament pairs | around first uncrimped weft filament of such filament pairs | first and second uncrimped weft filaments of such filament pairs | around second uncrimped weft filament of such filament pairs |

That is, the above weave types c1, c4, c2 and c3 differ only in that their entwining around first uncrimped weft filaments, their passing between first and second uncrimped weft filaments, their entwining around second uncrimped weft filaments and their passing between first and second uncrimped weft filaments is permutated cyclically over the indexes $N_A$, $N_B$, $N_C$ and $N_D$ when going from c1 to c4 to c2 to c3.

Figure 6:
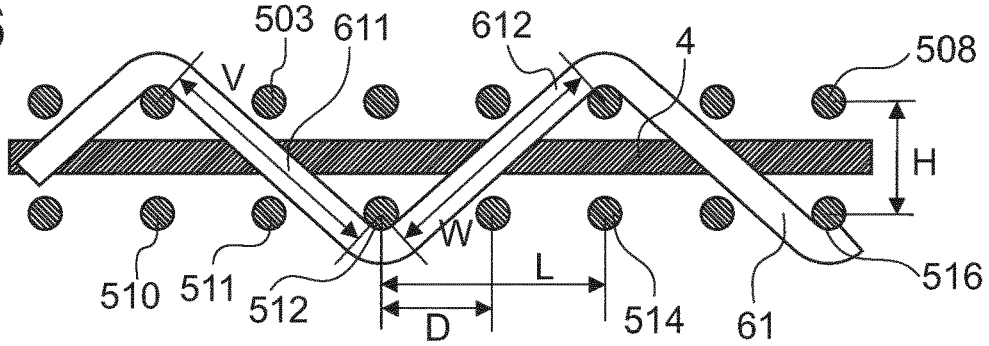
Figure 6:
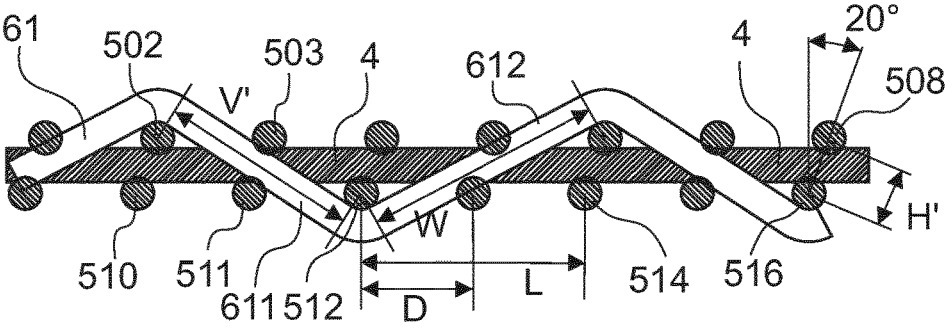

FIG. 6 is a schematic side view of the crimped warp filament 61 of the inventive fabric of FIGS. 4-5, once (upper part of FIG. 6) without shear and once (lower part of FIG. 6) at attempted 20° shear.

Analogously as the fabric of FIGS. 1-3, this crimped warp filament 61 has again falling filament portions (one indicated with numeral 611) of length V and again rising filament portions (one indicated with numeral 612) of length W, wherein W=V in the unsheared state. Again here, if the fabric is sheared, the rising filament portions 612 come under tensile stress. As in the fabric of FIGS. 1-3, the half pitch L and the length W of the rising filament portions 612 may be assumed unchanged in unsheared and sheared state if the uncrimped warp filaments 4 and the crimped warp filaments 61-64 are assumed of reasonable tenacity. Again analogously as in the fabric of FIGS. 1-3, the falling filament portions 611, when under shear, come under compressible stress and their length V' becomes schematically shorter under that compressible stress. That length V' is again calculable by above formula (1) and W contained therein again is calculable by above formula (2). The shortening of V' is again indicative of some bulking up or fluffing up of these falling filament portions 611, and thus of some tendency of an impregnation to delaminate under shear stress.

However, unlike to the fabric of FIGS. 1-3, in the fabric of FIGS. 4-6 the half pitch L of the weave in warp direction is not equal to the distance D between centres of adjacent uncrimped weft filaments; it its about twice that distance D. This is is because in the inventive fabric there are always extra filament pairs which allow passing of the crimped warp filaments 61-64 between their first and second uncrimped filaments. The half-pitch L in the inventive fabric is thus generally longer, typically about twice as long, as the half pitch L of the fabric of FIGS. 1-3 under otherwise identical features.

In keeping with the above explanation for to the behaviour of formula (1) with increasing half pitch L it is possible to predict that, at a given shear angle δ with otherwise identical parameters H, X, and Y (and thus W), the shortening of V' will be less pronounced with the fabric of FIGS. 4-5 than with the fabric of FIGS. 1-3, and that the ratio of V':V (=V':W) will generally be more close to unity than with the fabric of FIGS. 1-3. In the exemplary embodiment of FIGS. 4-6, wherein L=30 units, H=15 units, X=4.35, Y=4.35 units and 6=20°, one obtains with the above formulae: W=V=32.39 units, V'=26.29 units, and V':V (=V:W)=0.831.

This corresponds to a schematic shortening of the falling filament portions 611 at attempted 20° shear of only 16.9%. This schematic shortening is considerably less than the abovementioned 35.8% schematic shortening observed for the fabric of FIGS. 1-3 under 20° shear. By the less pronounced schematic shortening of the falling filament portions 611 of FIG. 6 with respect to the schematic shortening of the falling filament portions 311 of FIG. 3, it is possible to predict that the falling filament portions 611 of FIG. 6 will in reality not bulge outwards, bulk up or fluff up as strongly as the falling filament portions 311 of FIG. 3.

It is therefore firstly possible to predict that the fabric of FIGS. 4-6 under shear will have a lower tendency to delaminate an impregnation adhering to its falling filament portions 611 than the fabric of FIGS. 1-3 will have under the same shear for its falling filament portions 311.

Furthermore, in the fabric of FIGS. 4-6 there are the mentioned extra filament pairs (e.g. 503/511 or 508/516 in FIG. 6) which allow passing of the crimped warp filaments (e.g. 61 in FIG. 6) between their first and second uncrimped filaments. The formula for calculating the schematic distance H' between the centres of first uncrimped weft filament (e.g. 503 or 508 in FIG. 6) and second uncrimped weft filament (e.g. 511 or 516 in FIG. 6) in any such filament pairs in sheared state of the fabric is:

$$H'=L^2\sin^2(\delta)+H^2-L\sin(\delta) \quad (3)$$

wherein H, L and δ are as defined above.

Since L and H are always greater than zero, and since for meaningful shear angles δ the sin(δ) is greater than or equal zero, the H' calculated with formula (3) becomes smaller with increasing half-pitch L. The H' by formula (3) is equal to H when the shear angle δ is zero and becomes smaller than H when δ is greater than zero.

By the behaviour of above formula (3) it is therefore secondly possible to predict that, by virtue of H' becoming smaller with increasing shear angle δ, the said extra filament pairs (e.g. 503/511 in FIG. 6) will start to laterally compress the falling filament portions 611, which will partially counteract their said bulging outwards, bulking up or fluffing up, thus furthermore preventing delamination of the impregnation adhering to these falling filament portions 611.

By the behaviour of above formula (3) it is therefore thirdly possible to predict that, by virtue of H' converging towards zero with increasing half pitch L, the reduction of the distance H' will be more pronounced in the fabric of FIGS. 4-6 than in the fabric of FIGS. 1-3, because in the former fabric the half-pitch L is about twice the distance D between adjacent uncrimped weft filaments, whereas in the latter the half-pitch L is only equal to that distance D. Accordingly it its predicted that the fabric of FIGS. 4-6 cannot be sheared as strongly as the fabric of FIGS. 1-3, because of the stronger tendency of the former to become compressed (the more pronounced reduction of H'). The schematic representation in the lower part of FIG. 6 actually predicts that the fabric of FIGS. 4-6 resists a shearing to 20°, in view of the graphical overlap of the uncrimped weft filaments 501-516 with the crimped warp filament 61 and with the uncrimped warp filament 4. In contrast thereto, the fabric of FIGS. 1-3 can schematically be sheared to 20° without graphic overlap of any filaments.

The above considerations were made specifically for the crimped warp filament 61 appearing in FIGS. 4-5, but can be applied to any of the other crimped warp filaments 62, 63 and 64 shown therein, since they all have the same weaving type as crimped warp filament 61.

In view of the foregoing the fabric of FIGS. 4-6, when included into a belt and impregnated, is predicted to be less prone to shear delamination of that impregnation than the fabric of FIGS. 1-3 in an analogously impregnated belt. A suitable practical test setup for testing for resistance to delamination under shearing stress is described in the below examples.

Essential for this improved resistance to shear delamination is thus that the fabric of the invention contains both crimped warp filaments 61-64 of the weave type discussed for FIGS. 4-5 and contains uncrimped warp filaments 4, but does not contain any alternatingly entwining crimped warp filaments of the type discussed for FIGS. 1-3.

In keeping with the foregoing considerations, the inventive fabric may optionally contain, as shown in FIG. 4, a third layer (C) of uncrimped third weft filaments 517-524 running essentially in parallel to each other and being spaced apart from each other by said distance D. For each of the second uncrimped weft filaments (509 resp. 510 resp. 511 resp. 512 resp. 513 resp. 514 resp. 515 resp. 516 resp. 517) there is one corresponding uncrimped third weft filament 517 resp. 518 resp. 519 resp. 520 resp. 521 resp. 522 resp. 523 resp. 524, and vice versa, to form successive further filament pairs 509/517, 510/518, 511/519, 512/520, 513/521, 514/522, 515/523, 516/524. Each successive further filament pair comprising a given second uncrimped weft filament 509 resp. 510 resp. 511 resp. 512 resp. 513 resp. 514 resp. 515 resp. 516 resp. 517 is designable with the same index N as the successive filament pair comprising that same second uncrimped weft filament 509 resp. 510 resp. 511 resp. 512 resp. 513 resp. 514 resp. 515 resp. 516 resp. 517, as exemplified by above Table 1. There are then crimped further warp filaments 71-74 having one of the weave types c1-c4 discussed above for the crimped warp filaments 61-64. However, in these above weave descriptions, any reference to a "first uncrimped weft filament" needs to be replaced by a reference to a "second uncrimped weft filament" and any reference to a "second uncrimped weft filament" needs to be replaced by a reference to a "third uncrimped weft filament", in order to obtain the weave type description for the further crimped warp filaments 71-74.

It is preferred for the fabric of the invention that crimped warp filaments of above weave types c1 and c2 always appear pairwise and immediately adjacent to each other, and that crimped warp filaments of above weave types c3 and c4 always appear pairwise and immediately adjacent to each other. It is more preferred for the fabric of the invention that the crimped warp filaments 61-64 and the uncrimped warp filaments 4 are present in repetitive units in weft direction, wherein the order in which crimped warp filaments 61 (with weave type c1), crimped warp filaments 62 (with weave type c2), crimped warp filaments 63 (with weave type c3), crimped warp filaments 64 (with weave type c4) and uncrimped warp filaments 4 are arranged in weft direction is always the same. If a third layer C of uncrimped weft filaments 517-524 is present, then it is again preferred that the further crimped warp filaments 71-74 and the further uncrimped warp filaments 8 are present in repetitive units, wherein the order in which crimped further warp filaments 71 (with weave type c1), crimped further warp filaments 72 (with weave type c2), crimped further warp filaments 73 (with weave type c3), crimped further warp filaments 74 (with weave type c4) and uncrimped further warp filaments 8 appear is always the same, and is the same as the order within the repetitive units of crimped warp filaments 61-64 and uncrimped warp filaments 4.

In one preferred embodiment of the fabric the ratio of crimped warp filaments 61-64 to uncrimped warp filaments 4 may be 4:1. If therein these warp filaments occur in repetitive units, wherein the order of the filaments in these repetitive units is always the same, then exemplary such orders (filament numbers and, where applicable, weave types in parentheses) are 61(*c*1)-62(*c*2)-4-63(*c*3)-64(*c*4) or any cyclic permutation thereof. Analogously, if a third layer C of further uncrimped weft filaments 71-74, further crimped warp filaments 517-524 and further uncrimped warp filaments 8 are present, then the order of these filaments would accordingly be 71(*c*1)-72(*c*2)-8-73(*c*3)-74(*c*4) or the cyclic permutation thereof that corresponds to the above cyclic permutation.

In another preferred embodiment of the fabric the ratio of crimped warp filaments 61-64 to uncrimped warp filaments 4 may be 12:1. If therein these warp filaments occur in repetitive units, wherein the order of the filaments in these repetitive units is always the same, then exemplary such orders (filament numbers and, where applicable, weave types in parentheses) are 63(*c*3)-64(*c*4)-61(*c*1)-62(*c*2)-63(*c*3)-64(*c*4)-4-61(*c*1)-62(*c*2)-63(*c*3)-64(*c*4)-61 (c1)-62(*c*2) or any cyclic permutation thereof. Analogously, if a third layer of further uncrimped weft filaments 71-74, further crimped warp filaments 517-524 and further uncrimped warp filaments 8 are present, then the order of these filaments would accordingly be 73(*c*3)-74(*c*4)-71(*c*1)-72(*c*2)-73(*c*3)-74(*c*4)-8-71(*c*1)-72(*c*2)-73(*c*3)-74(*c*4)-71(*c*1)-72(*c*2) or the cyclic permutation thereof corresponding to the above cyclic permutation.

If the warp filaments occur in repetitive units, wherein the order of the filaments in these repetitive units is always the same, and antistatic filaments are also present, then preferably again these antistatic filaments are included always at the same position within a repetitive unit. Apart from that, their number and position(s) in a repetitive unit is arbitrary. Preferably there is one such antistatic filament per repetitive unit.

It is preferred for the fabric of the invention that all uncrimped weft filaments 501-524 are monofilaments, more preferably such monofilaments having a diameter in the range of 0.05 to 2 mm, preferably of 0.25 to 0.45 mm. The uncrimped weft filaments are preferably made of polyester, such as PET. The titer of the uncrimped weft filaments is preferably in the range of 670 to 2100 dtex.

It is preferred for the fabric of the invention that all crimped warp filaments 61-64, 71-74 are multifilaments, spun yarns or a combination of multifilament yarns and staple fibres spun together by the commonly known "core-spinning" process. Any such crimped warp filaments are preferably devoid of natural fibres, such as cotton, jute, hemp or cellulose-based fibres. The impregnation adheres sufficiently to the inventive fabric even in the absence of such natural fibres. The crimped warp filaments are preferably made of polyester such as PET. The titer of the crimped warp filaments is preferably in the range of 500 to 2000 dtex, particularly if made from polyester such as PET. Also preferably, the tenacity of the crimped warp filaments is preferably in the range of 15 to 250 cN/tex, more preferably in the range of 15 to 40 cN/tex and most preferably of 20 to 30 cN/tex. Also preferably, their heat shrinkage (percentual length reduction under heating for 2 min at 180° C.) is in the range of 0.5 to 15%, more preferably of 5 to 15% and most preferably of 8 to 12%. Also preferably, if the crimped warp yarns are spun yarns, then they may preferably have a number of turns per metre preferably being in the range of 0 to 400, more preferably of 250 to 400 and most preferably of 300 to 400

It is preferred for the fabric of the invention that all uncrimped warp filaments 4, 8 are multifilaments, or a plurality of such multifilaments, e.g. 3-8 such multifilaments, arranged in parallel and immediately adjacent to each other. The uncrimped warp filaments are preferably made of polyester, in particular PET, or aramid. The titer of the uncrimped warp filaments (or, if there is a plurality of multifilaments, the sum of the titer of all them) is preferably in the range of 500 to 5000 dtex. More preferably, if the uncrimped warp filaments are of polyester such as PET, their titer (or, if there is a plurality of multifilaments, the sum of the titer of all them) is in the range of 550 to 2000 dtex; if they are of Aramid, then their titer is more preferably in the range of 440 to 3500 dtex. Also preferably, the tenacity of the uncrimped warp filaments (or, if there is a plurality of multifilaments, the overall tenacity of the entire plurality) is preferably in the range of 15 to 250 cN/tex, more preferably in the range of 30 to 100 cN/tex and most preferably of 60 to 80 cN/tex. Also preferably, their heat shrinkage (percentual length reduction under heating for 2 min at 180° C.) is in the range of 0.5 to 15%, more preferably of 0.5 to 5% and most preferably of 1 to 2%. Also preferably, the uncrimped warp multifilaments may preferably have an S- or Z-twist, with the number of turns per metre preferably being in the range of 0 to 400, more preferably of 50 to 300 and most preferably of 70 to 140.

The fabric of the invention may optionally furthermore comprise crimped antistatic filaments, as known in the prior art. These crimped antistatic filaments then have one of the weave types c1-c4 exemplified above. These antistatic filaments preferably are spun yarns, e.g. of carbon fibres, or are conductive polyester, cotton, nylon or aramid fibres having a metallic conductor adhered thereto, coated thereonto or embedded therein. Such conductive fibres are as such conventional. The tenacity of the crimped antistatic filaments is preferably in the range of 15 to 250 cN/tex, more preferably in the range of 15 to 40 cN/tex and most preferably of 20 to 30 cN/tex. Also preferably, their heat shrinkage (percentual length reduction under heating for 2 min at 180° C.) is in the range of 0.5 to 15%, more preferably of 5 to 15% and most preferably of 8 to 12%. Also preferably, the crimped antistatic filaments may preferably have an S- or Z-twist, with the number of turns per metre preferably being in the range of 0 to 400 and more preferably of 100 to 400. More preferably there is exactly one crimped antistatic filament separated by every four consecutive uncrimped warp filaments.

The belt of the invention is made by providing a fabric of the invention, as described above, and impregnating this according to standard procedures, such as melt coating, calendering, rotocure, etc., with an impregnation of an elastomer (rubber), a thermoplastic or a thermoplastic elastomer. By "impregnation" is meant that the fabric is completely embedded into the impregnation, with no filament segments protruding from the top and bottom surfaces of the belt. "Impregnation" may also mean that the belt may have a top and a cover layer each consisting only of the impregnation, and providing said top and bottom surfaces, respectively, of the belt. In one preferred embodiment, this top layer is relatively thick, such as about 10 to 30% of the belt's overall thickness, and the bottom layer is relatively thin, such as about 1 to 5% of the belt's overall thickness. In this preferred embodiment, the top layer's top surface is the one where goods are conveyed, and the bottom layer's bottom surface is the one that comes into contact with a support and/or rollers. The thin bottom layer minimizes abrasion of impregnation material when being in contact with the support and/or the rollers, which is advantageous when there is shear between the top and bottom surfaces. In another preferred embodiment, both the top layer and the bottom layer are relatively thick, such as about 10 to 30% of the belt's overall thickness, and then either of the top and bottom layers may serve to convey goods or to be in contact with the support and/or the rollers. More preferably then, both the top and the bottom layers have the same thickness. This allows the belt's orientation to be inverted, if one of the top or the bottom layer should have become too strongly abraded, thus extending the belt's service life.

The elastomer (rubber) as the impregnation may preferably be selected from natural rubber, polyisoprene, polybutadiene, styrene-butadiene rubber (SBR), nitrile-butadiene rubber (NBR), ethylene-propylene-diene rubber (EPDM) and acrylate rubber. It is preferably impregnated into the fabric in unvulcanised or uncrosslinked state and subsequently vulcanized or crosslinked according to customary procedures.

The thermoplastic as the impregnation may preferably be selected from the group consisting of thermoplastic polyolefins (such as polyethylene or polypropylene), substantially random ethylene/C3-12-α-olefin copolymers (examples of the α-olefin being 1-propene, 1-butene, 1-pentene, 1-hexene and 1-octene), thermoplastic polyamides, ethylene-vinylacetate copolymers, poly(vinylacetate) and PVC.

The thermoplastic elastomer as the impregnation may preferably be selected from the group consisting of thermoplastic elastomeric block copolymers (such as styrenic block copolymers, in particular styrene-butadiene-styrene, styrene-isoprene-styrene, styrene-ethylene/butylene-styrene and styrene-ethylene/propylene-styrene block copolymers), copolymers of hard blocks of medium density polyethylene and of soft blocks of ethylene/α-olefin copolymers, thermoplastic polyurethanes (such as copolymers of polyester diols or polyether diols with diisocyanates), polyether-/ester block amides and thermoplastic elastomeric ionomers.

The impregnation is preferably made of a thermoplastic elastomer, more preferably of a TPU. Suitable TPU's may be obtained by reacting diisocyanate-containing hard block segments with polyester diol soft block segments. Preferably the impregnation is applied to the fabric without the aid of any adhesion promoters. That is, both the inventive fabric before impregnation and the impregnating composition itself are devoid of such adhesion promoters. The impregnation adheres to the inventive fabric even in the absence of such adhesion promoters. Exemplary customary adhesion promoters that are preferably absent are halogenated polymers, in particular chlorinated polyolefins, comprising a crosslinking agent.

The belt of the invention may optionally be coated on its top and/or bottom surfaces with customary coatings, e.g. which enhance resistance against solvents, or which contain antibacterial agents.

Figure 7:
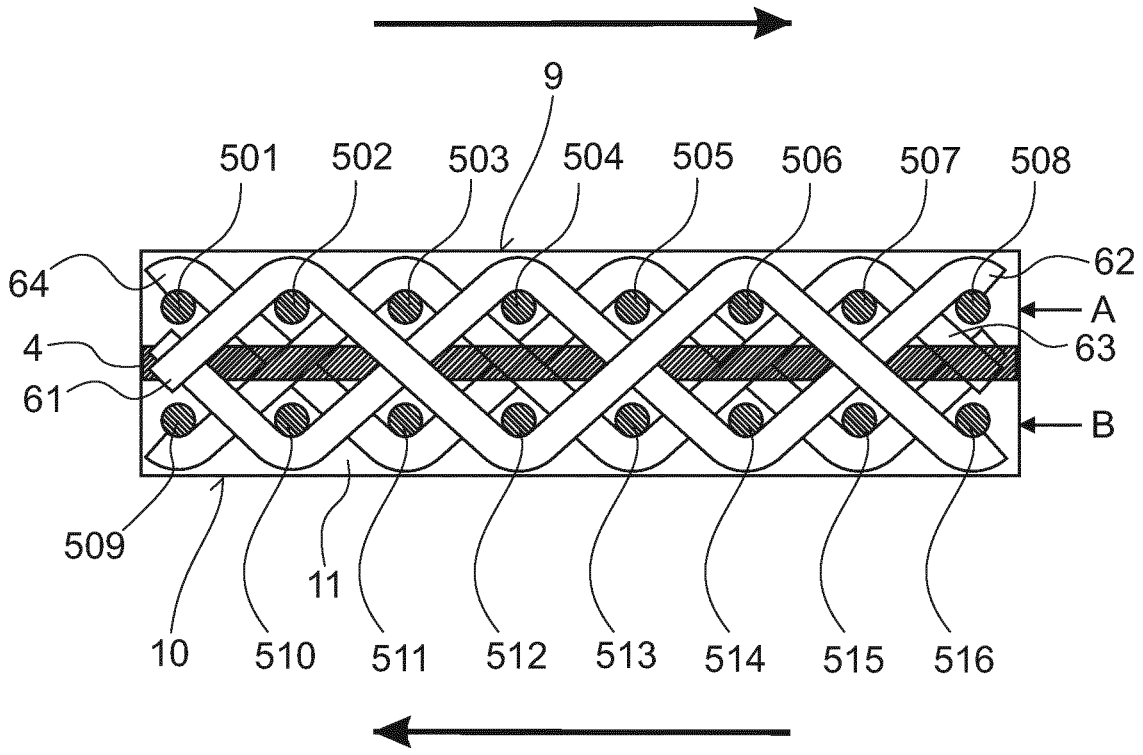
FIG. 7 is a schematic cross-sectional view of a belt of the invention with the fabric of FIG. 4.

FIG. 7 is a schematic cross-sectional view of a belt of the invention containing the fabric of the invention, along its longitudinal direction, cutting through the uncrimped warp filament 4 and the first uncrimped and second weft filaments 501-508 and 509-516, respectively. The longitudinal direction of the belt is for the purposes of the invention also considered to be the belt's travel direction. Accordingly the fabric's warp direction (along the crimped warp filament's 61-64) coincides with the belt's longitudinal direction. The first uncrimped and second weft filaments 501-508 and 509-516, respectively, are monofilaments made of polyester and in the exemplified embodiment have a thickness of 0.25-0.45 mm. The uncrimped warp filament 4 is typically a multifilament made of polyester or, more preferable, of Aramid. In the exemplified embodiment it may either be one single Aramid multifilament of 440 to 3500 dtex, or a plurality of such multifilaments, e.g. 3-8 such filaments, arranged in parallel and immediately adjacent to each other. The crimped warp filament's 61-64 are typically multifilaments made of polyester and in the exemplified embodiment have a titer of 550 to 2000 dtex. There are typically 4 or 12 crimped warp filaments 61-64 per uncrimped warp filament 4, wherein the latter ratio of 12:1 applies in particular to the above mentioned embodiment of the uncrimped warp filament 4 being a plurality of filaments arranged in parallel and immediately adjacent to each other. This belt of the invention has an overall thickness of typically in the range of 1 to 3 mm. The two arrows indicate the opposite directions of frictional forces that act onto the belt's top side 9 and on the belt's bottom side 10 and which cause a shear inside the belt. This is the shear that would typically occur in an application according to the invention of such belt. This belt has an impregnation 11 made of a thermoplastic or thermoplastic elastomer, in particular a TPU, such as of Lubrizol's Estane® TPU types. This exemplary impregnated conveyor belt is considered as an example of a light conveyor belt.

Exemplary uses of the belt of the invention where a shear between the belt's top surface and bottom surface in the belt's longitudinal direction occurs or is expected to occur are now described.

A first such use is in food processing. There the belt's top surface is intermittently cleaned in running operation from debris, dust or dirt using a knife which grates along the top surface. The grating knife exerts a shear onto the belt.

A second such use is in treadmills. There the belt runs over a fixed supporting board, whereas the runner exercising on the treadmill accelerates the belt's top surface with his feet while running on the section of the belt lying on said supporting board. The shear occurs between the belt's bottom side lying on the fixed board and the belt's top side being accelerated by the runner's feet.

A third such use is in mail sorting machines. There are driven belts which convey a piece of mail by cooperating with a fixed support or by cooperating with a non-driven belt. The fixed support does not move at all. Therefore the piece of mail exerts a braking, thus shearing, action onto the driving belt's top surface while being conveyed by the driving belt. Similarly a shear occurs in the non-driven belt because it is accelerated over its top surface by the the conveyed piece of mail. Details of such mail sorting machines and of the above two mail conveying methods are disclosed in FIGS. 3-5 and the associated description of WO 2015/011090 A1.

Further to improved resistance to delamination under shearing stress, as discussed above with reference to FIGS. 1-6, the inventive belt also exhibits improved resistance to delamination under so called "wear and tear" conditions, namely under prolonged cycling with bending over pulleys of small diameter. This was determined experimentally and is described in the below examples, also with reference to FIGS. 8-9.

The invention will now be illustrated by the following non-limiting examples.

EXAMPLES

Example 1: Test Setup for Testing for Resistance to Delamination Under "Wear and Tear" Conditions or Under Shearing Stress The test setup allows for testing for susceptibility to delamination under either predominantly "wear and tear" conditions (FIG. 8) or under predominantly "shearing" conditions (FIG. 9). In both setups the endless belt (inventive or comparative) is cycled in a loop comprising at least a driving pulley 12 and idler pulleys 13,14 which all impart the belt a convex bend.

In the "wear and tear" setup (FIG. 8) there is a further idler pulley 15 which imparts the belt a concave bend. The idler pulleys 13,14,15 are of sufficiently small diameter (typically 30-40 mm at the most) such as to cause, by the repeated bending around these small diameter pulleys, a fatigue in the interface between fabric and impregnation.

In order to account for having two convex bending pulleys 13,14 and only one concave bending pulley 15 it is possible to choose the diameter of the latter smaller than the diameter of the two former, to have the same "wear and tear" effect in both convex and concave bending directions.

In the "shearing" setup (FIG. 9) there is however a further concave bending braking pulley 16. This pulley 16 counteracts by a braking torque $T_B$ [Nm] exerted onto its axle 161 or onto its surface (the figure shows an exemplary shoe brake 17 acting onto the braking pulley's surface) the driving torque $T_D$ [Nm] exerted by the driving pulley 12. The driving torque $T_D$ acts on the belts interior (pulley) surface, whereas the braking torque $T_B$ acts on the belt's exterior (conveying) surface. These two torques produce in the belt longitudinal forces in opposing directions, namely a driving force $F_D$ and a braking force $F_B$, and thus a shear in the belt. $T_D$ must be greater than $T_B$ so that the belt keeps looping. Furthermore the coefficients of friction between belt surfaces and pulley surfaces, the forces inside the belt (produced by $T_D$, $T_B$ and Fw) and the angles by which the belt sweeps over the driving pulley 12 and the braking pulley 16 must be such as that no slipping over either of these two pulleys occurs. This can however be easily be determined either over the Eytelwein formula or by experiment.

FIG. 9 shows the driving pulley 12 and braking pulley 16 rotating counterclockwise, accordingly the said forces in opposing directions and the shear, again designated by 6, arise mainly on the right side of the belt loop, as shown in the figure.

If driving pulley 12 and braking pulley 16 rotated clockwise, then the opposing forces and the shear would arise mainly on the left side of the belt loop.

In the "shearing" setup of FIG. 9 all pulleys are of sufficiently large diameter (typically at least 100 mm, preferably 130 mm or more) so as to minimise the "wear and tear" effects by the bending over the pulleys.

Figure 8:
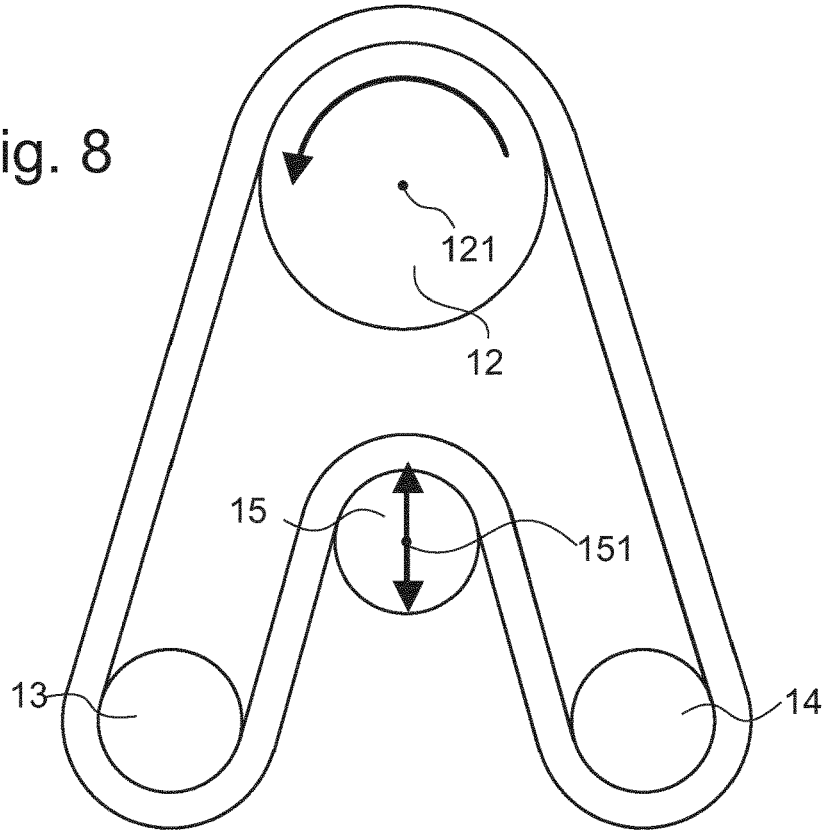
FIGS. 8 and 9 illustrate a test setup for testing against delamination under "wear and tear" conditions and under shear stress, respectively.
Figure 9:
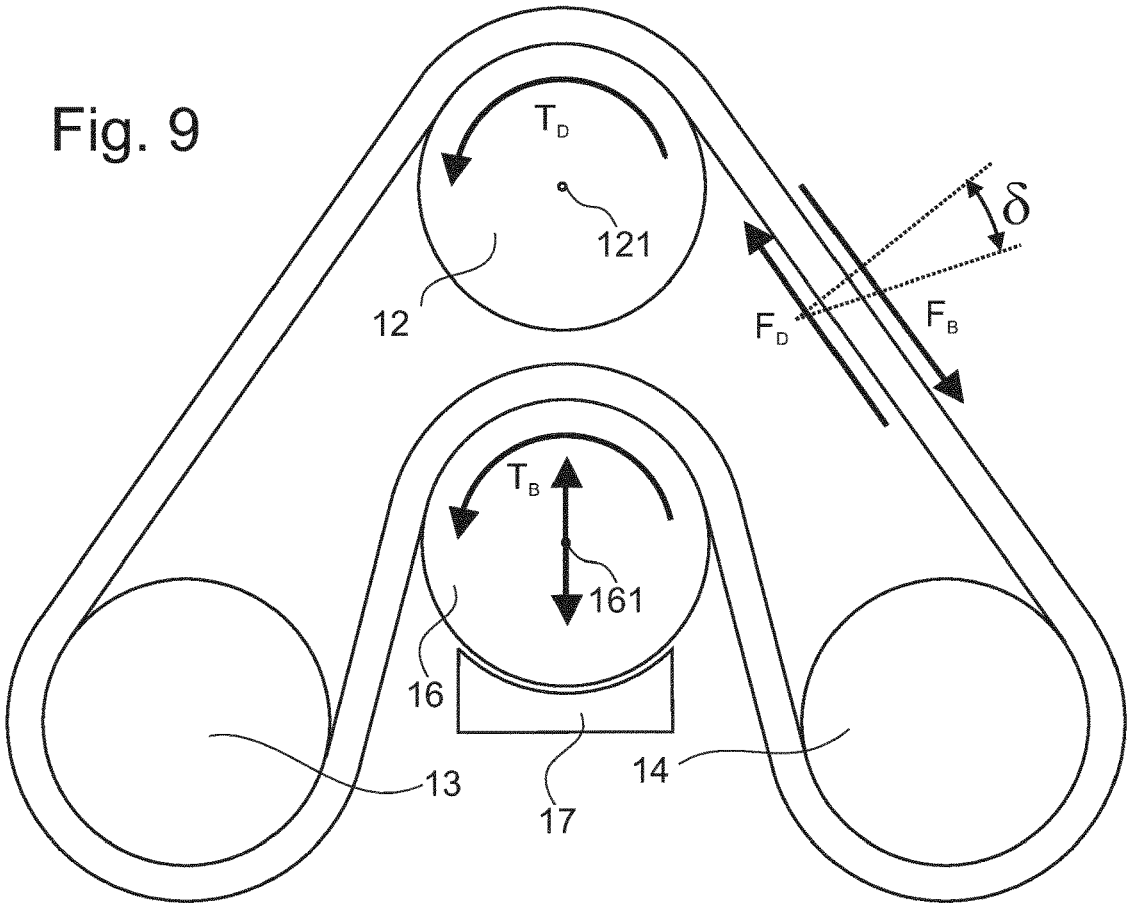

In both setups of FIGS. 8 and 9 the concave bending pulleys (idler pulley 15 and braking pulley 16) are located on an axle 151 or 161, respectively, which can be displaced vertically (double arrows in both FIGS. 8 and 9) and which, by an appropriate tensioning force Fw, can impart the belt the required tensioning. Fw [N] is calculated according to the formula:

$$Fw=2\times k_{1\%}\times b\times \varepsilon_0$$

wherein:

$k_{1\%}$ is the tensile force needed to achieve 1% elongation per unit of belt width [N/mm], determined after relaxation according to EN ISO 21181: 2013 (light conveyor belts—determination of the relaxed elastic modulus), which in the "wear and tear" setup of FIG. 8 is determined on the open belt before any cycling;

in the "shearing" setup of FIG. 9 is determined on the re-opened belt, after "running in" in endless form by cycling 10'000 times on that test setup;

b is the width of the belt [mm], which can be arbitrarily chosen, but is typically in the range of 10 to 50 mm; and $\varepsilon_0$ is the belt elongation [%] that is intended in the test setup after relaxation, normally 0.5%.

The Fw is applied perpendicularly to the axle 151 or 161, e.g. by means of a counterweight or by means of a spring scale.

Example 2: Comparative Test of an Inventive Belt and a Prior Art Belt for Resistance to Delamination Under "Wear and Tear" Conditions An inventive belt, containing a fabric construction similar as the one of FIG. 4 was compared with a prior art belt marketed by the applicant under the code EMB-12EMCH, having two discrete layers of plain weave PET. The test setup was similar to the one of FIG. 8, to show improvement of the inventive belt with respect to delamination susceptibility under "wear and tear" conditions. The parameters of the belt and of the test setup were as in following Table 3:

TABLE 3

| | Inventive belt | EMP-12EMCH (prior art) |
|---|---|---|
| overall belt thickness [mm] | 1.2 | 1.7 |
| $k_{1\%}$ (measured after relaxation before any looping) [N/mm] | 11 | 13 |
| Diameter of driving pulley 12 [mm] | 130 | 130 |
| Diameter of idler pulleys 13, 14, 15 [mm] | 30 | 40 |
| b [mm] | 40 | 40 |
| $\varepsilon_0$ [%] | 0.5 | 0.5 |
| Fw [N] | 440 | 520 |
| Number of cycles by which belt was looped over the test setup | 5 million | 5 million |
| cycling speed [m/s] | 10 | 10 |
| Impregnation material | thermoplastic polyurethane (TPU), Estane type | thermoplastic polyurethane (TPU), Estane type |
| end joining type to make belt endless for looping | finger end, using TPU impregnation as hotmelt adhesive | finger end, using TPU impregnation as hotmelt adhesive |

The assessment of the two belts was as follows:

Inventive belt: There was no peeling off of the impregnation after the test. Neither were there any cracks or disruptions visible on either of the two belt sides, whether outside of the finger end joint are or at the finger end joint area. It was not possible to peel the impregnation layer off the double layer fabric, neither before nor after the test; the adhesion of the impregnation to the double fabric was always higher than the adhesion within the impregnation layer itself.

Prior art belt: The belt showed after the test several types of defects, among which cracks and disruptions in longitudinal and/or transversal direction (both outside and inside the finger end area). It was possible to peel the impregnation layer off the fabric. Before the test the required force for peeling off the impregnation was in the range of 30-50 N per cm of belt width; after the test the required force was lowered to less than 10 N per cm of belt width. Sometimes the two individual fabrics could be peeled off from each other.

The invention claimed is:

1. A woven fabric comprising:

a) A first layer (A) of first uncrimped weft polyester monofilaments having a diameter in the range of 0.05 to 2 mm and running essentially in parallel to each other and being spaced apart from each other by a distance D;

b) a second layer (B) of second uncrimped weft polyester monofilaments having a diameter in the range of 0.05 to 2 mm and running essentially in parallel to each other and being spaced apart from each other by said distance D;

wherein for each of the first uncrimped weft polyester monofilaments there is one corresponding second uncrimped weft polyester monofilament, and vice versa, to form successive filament pairs, each such successive filament pair being designable with a unique and ascending integer index N;

c) crimped warp filaments having a tenacity in the range of 15 to 40 cN/tex and one of the following weave types c1-c4:

c1—entwine around first uncrimped weft polyester monofilaments of all filament pairs with indexes N fulfilling (N mod 4)=0, such indexes N being designated as $N_A$; pass between first and second uncrimped weft polyester monofilaments of all filament pairs with indexes N fulfilling (N mod 4)=1, such indexes N being designated as $N_B$; entwine around second uncrimped weft polyester monofilaments of all filament pairs with indexes N fulfilling (N mod 4)=2, such indexes N being designated as $N_C$; and pass between first and second uncrimped weft polyester monofilaments of all filament pairs with indexes N fulfilling (N mod 4)=3, such indexes N being designated as $N_D$; or c2—entwine around second uncrimped weft polyester monofilaments of all filament pairs with said indexes $N_A$; pass between first and second uncrimped weft polyester monofilaments of all filament pairs with said indexes $N_B$; entwine around first uncrimped weft polyester monofilaments of all filament pairs with said indexes $N_C$; and pass between first and second uncrimped weft polyester monofilaments of all filament pairs with said indexes $N_D$; or c3—pass between first and second uncrimped weft polyester monofilaments of all filament pairs with said index $N_A$; entwine around first uncrimped weft polyester monofilaments of all filament pairs with said indexes $N_B$; pass between first and second uncrimped weft polyester monofilaments of all filament pairs with said indexes $N_C$; and entwine around second uncrimped weft polyester monofilaments of all filament pairs with said indexes $N_D$; or c4—pass between first and second uncrimped weft polyester monofilaments of all filament pairs with said indexes $N_A$; entwine around second uncrimped weft polyester monofilaments of all filament pairs with said indexes $N_B$; pass between first and second uncrimped weft polyester monofilaments of all filament pairs with said indexes $N_C$; and entwine around first uncrimped weft polyester monofilaments of all filament pairs with said indexes $N_D$; and d) uncrimped warp filaments having a tenacity in the range of 30 to 100 cN/tex and passing between first and second uncrimped weft polyester monofilaments of all filament pairs;

wherein the numerical ratio of crimped warp filaments c) to uncrimped warp filaments d) is in the range of 4:1 to 12:1; and wherein the fabric does not comprise crimped warp filaments which entwine around the first and second uncrimped weft polyester monofilaments in alternating manner.

2. The fabric of claim 1, wherein the crimped warp filaments of weave types c1 and c2 defined in claim 1 are always present pairwise and immediately adjacent to each other, and the crimped warp filaments of weave types c3 and c4 defined in claim 1 are always present pairwise and immediately adjacent to each other.

3. The fabric of claim 1, wherein the crimped warp filaments c) and the uncrimped warp filaments d) are arranged in repetitive units in weft direction, in which repetitive units the order in which the uncrimped warp filaments d) and the crimped warp filaments of above weave types c1, c2, c3 and c4 are arranged in weft direction is always the same.

4. The fabric of claim 1, consisting of first uncrimped weft polyester monofilaments a), second uncrimped weft polyester monofilaments b), crimped warp filaments c) and uncrimped warp filaments d).

5. The fabric of claim 1, furthermore comprising e) crimped antistatic filaments having one of the weave types c1, c2, c3 or c4 defined in claim 1.

6. The fabric of claim 5, wherein all crimped antistatic filaments have the same weave type.

7. The fabric of claim 6, consisting of first uncrimped weft filaments a), second uncrimped weft filaments b), crimped warp filaments c), uncrimped warp filaments d) and crimped antistatic filaments.

8. The fabric of claim 6, wherein the crimped warp filaments c), the uncrimped warp filaments d) and the antistatic filaments are arranged in repetitive units in weft direction, in which repetitive units the order in which uncrimped warp filaments d), crimped warp filaments of weave types c1, c2, c3 and c4, and antistatic filaments are arranged in weft direction is always the same.

9. A belt having a top surface and a bottom surface and comprising a fabric according to claim 1, oriented such that any warp filaments contained therein run in the belt's longitudinal direction, the fabric being impregnated with an impregnation of an elastomer, a thermoplastic or a thermoplastic elastomer.

10. The belt of claim 9, wherein the impregnation is of a thermoplastic elastomer.

11. The belt of claim 10, wherein the thermoplastic elastomer is TPU.

12. A conveying process in which conveyance is done on a belt according to claim 9 and wherein during said conveying, a shear is applied or is allowed to occur between the belt's top surface and bottom surface in the belt's longitudinal direction.

13. A process of conveying a food wherein the food is conveyed on the top surface of a belt according to claim 9 and wherein the belt's top surface is intermittently cleaned from debris, dust or dirt using a knife which grates along the top surface.

14. A treadmill comprising a belt according to claim 9.

15. A mail sorting machine comprising a belt according to claim 9.

16. The fabric of claim 1, wherein the first and second uncrimped weft polyester filaments have a diameter in the range of 0.25 to 0.45 mm.

* * * * *